US006736060B2

(12) United States Patent
Masuch

(10) Patent No.: US 6,736,060 B2
(45) Date of Patent: May 18, 2004

(54) PRINTING UNIT

(75) Inventor: Bernd Kurt Masuch, Kürnach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/380,175

(22) PCT Filed: Sep. 17, 2001

(86) PCT No.: PCT/DE01/03562

§ 371 (c)(1),
(2), (4) Date: Mar. 19, 2003

(87) PCT Pub. No.: WO02/24458

PCT Pub. Date: Mar. 28, 2002

(65) Prior Publication Data

US 2004/0050275 A1 Mar. 18, 2004

(30) Foreign Application Priority Data

Sep. 20, 2000 (DE) ..... 100 46 374
Sep. 20, 2000 (DE) ..... 100 46 371

(51) Int. Cl.[7] ..... B41F 5/16

(52) U.S. Cl. ..... 101/177; 101/181; 101/216; 101/248; 101/483

(58) Field of Search ..... 101/142, 177, 101/181, 216, 217, 219, 226, 248, 483

(56) References Cited

U.S. PATENT DOCUMENTS 3,908,545 A * 9/1975 Simeth ..... 101/350.4
4,353,299 A * 10/1982 Murai et al. ..... 101/144
4,484,522 A * 11/1984 Simeth ..... 101/248
4,729,309 A 3/1988 Saterini et al.
5,218,903 A * 6/1993 McConnell et al. ..... 101/148
5,787,811 A 8/1998 Achelpohl et al.
5,983,793 A * 11/1999 Volz et al. ..... 101/216
5,983,794 A 11/1999 Emery
6,332,397 B1 12/2001 Bolza-Schünemann et al.
6,393,987 B1 * 5/2002 Bolza-Schünemann et al. .. 101/483
6,408,748 B1 * 6/2002 Hajek et al. ..... 101/177
6,644,184 B1 * 11/2003 Hajek et al. ..... 101/177

FOREIGN PATENT DOCUMENTS

| | | |
|---|---|---|
| DE | 33 13 219 A1 | 10/1984 |
| DE | 196 03 663 A1 | 8/1997 |
| DE | 196 40 649 A1 | 4/1998 |
| DE | 197 23 043 A1 | 12/1998 |
| DE | 197 32 330 A1 | 2/1999 |
| DE | 198 22 893 A1 | 11/1999 |
| EP | 0 234 456 | 9/1987 |
| EP | 0 498 012 A1 | 8/1992 |
| EP | 0 796 733 A1 | 9/1997 |
| EP | 0 997 273 A2 | 5/2000 |

OTHER PUBLICATIONS

"Digitaler Direktantrieb an Druckmaschinen," Druckspiegel, Sep. 1999, pp. 53–56.

* cited by examiner

*Primary Examiner*—Eugene H. Eickholt
(74) *Attorney, Agent, or Firm*—Jones Tullar & Cooper, PC

(57) ABSTRACT

A printing unit is comprised of at least three rotating members, such as an impression cylinder, a forme cylinder that cooperates with the impression cylinder in a printing position, and a roller that cooperates with the forme cylinder. The two, cylinders and the roller may gave a zero rotational speed or a production rotational speed. At least two of the rotating member also have a set-up rotational speed that is different from the zero rotational speed and the production rotational speed of these rotating members.

23 Claims, 2 Drawing Sheets

PRINTING UNIT

FIELD OF THE INVENTION

The present invention is directed to a printing unit which includes at least three rotating bodies. These are a forme cylinder, a satellite cylinder and an inking roller.

BACKGROUND OF THE INVENTION

A four-cylinder printing unit is known from DE 196 03 663 A1. Two transfer cylinders which cooperate with each other are fixedly coupled to each other and can be selectively driven by the drive mechanism of one or of both associated forme cylinders, or via a transverse shaft which can be connected to the motors. In one mode of operation, one of the forme cylinders can be stopped for a plate change. The associated transfer cylinder continues to run synchronously with the second forme cylinder.

A five-cylinder printing unit, described in DE 197 32 330 A1, has a mode of operation wherein one of the forme cylinders can be stopped for a plate change. The associated transfer cylinder is either also stopped or is rotatable, together with the forme cylinder, independently of the remaining three cylinders.

EP 0 997 273 A2 discloses a mode of operation of a four-cylinder printing unit wherein a forme cylinder is moved away from the remaining cooperating cylinders. In one example, the moved- away forme cylinder can be rotated by a drive motor, and in another example, it can be rotated by an auxiliary motor.

SUMMARY OF THE INVENTION

The object of the present invention is directed to providing a printing unit.

In accordance with the invention, this object is attained by providing a printing unit with at least three rotating bodies that cooperate in pairs to form a print-on position. These include a satellite cylinder, a forme cylinder, which cooperates with the satellite cylinder in the print-on position, and at least one inking roller which cooperates with the forme cylinder in the print-on position. At least two of these three rotating bodies simultaneously have a set-up rotational speed that is different from a production rotational speed and from a zero rotational speed.

The advantages which can be obtained by the present invention reside, in particular, in that a large operational diversity and variability of a printing unit or a cylinder assembly is created.

For example, it is possible, in this way, to move cylinders or groups of cylinders independently of each other at different rotational speeds, or also in different directions of revolutions which may be required, for example, when drawing in a paper web, or in the course of independent inking or washing of rollers and cylinders. In particular, different actions when setting up at set-up rotational speeds, or operations at speeds different from the stop or zero rotational speed, or the production rotational speed for the individual cylinder types are therefore possible on cylinders or groups of cylinders next to each other and with a paper web running or stopped.

The simultaneous meeting of several different demands made on different components of a printing group or of a printing unit is particularly advantageous. For one, the different operational modes of the components contribute to time savings and therefore to a lowering of the production costs, and furthermore make possible the performance of various set-up operations with the paper web running at production speed or at a draw-in speed. A flying plate change for single or doubled-sided imprint operations is possible. For example, in advantageous operational states, a printing forme is changed or pre-inked, while washing, pre-inking or also a change of the dressing takes place at the associated steel cylinder.

In particular, in connection with printing units which have a counter-pressure cylinder which is embodied as a steel cylinder, for example, various options for setting-up the cylinders without mutual interference arise while the paper web, for example, is drawn in at draw-in speed during a production start. Together with the modes of operation, or operational states in accordance with the present invention, these printing units permit the guidance of the paper web at draw-in speed while set-up work can take place at a forme cylinder.

For reasons of flexibility and of savings of time, as well as of waste, the operational states, in accordance with the present invention are of great importance in the course of cylinder set-up or fitting prior to start-up, or at the end of the printing operation. For example, the forme cylinder and the inking roller can simultaneously pass through-different set-up programs.

The independent operation of the rollers for ink application, which are assigned to the forme cylinders, is also advantageous. For example, washing or pre-inking of these rollers can take place regardless of the rotational speed and of the direction of rotation and while the forme cylinder also passes through a set-up program.

BRIEF DESCRIPTION OF THE DRAWINGS

Preferred embodiments of the present invention are represented in the drawings and will be explained in greater detail in what follows.

Shown are in.

DESCRIPTION OF THE PREFERRED EMBODIMENTS

Figure 2:
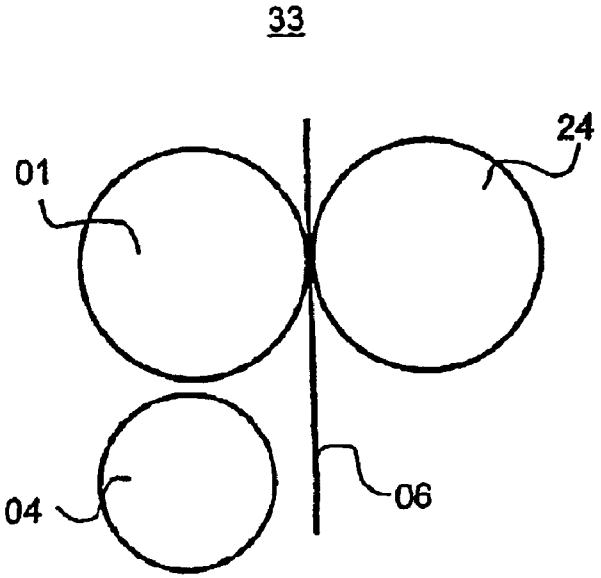
Figure 1:
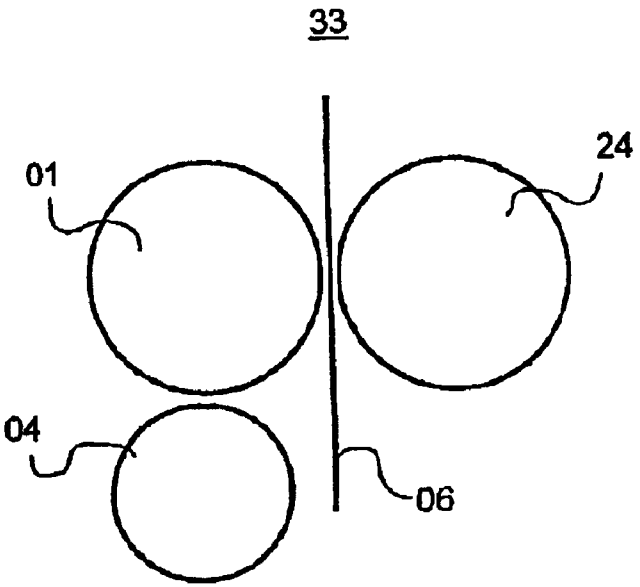
FIG. 1, a schematic side elevation view of a two-cylinder printing unit with a roller in accordance with the present invention, FIG. 2, a schematic side elevation view of a two-cylinder printing unit with the roller moved away, FIG. 3, a schematic side elevation view of a two-cylinder printing unit with a roller and with an additional forme cylinder, and in FIG. 4, a schematic side elevation view of a two-cylinder printing unit and with an additional forme cylinder.

A printing unit of a printing press, in particular a rotary printing press is depicted in FIG. 1, and has a first cylinder 01, for example a forme cylinder 01. The forme cylinder 01 cooperates through a web of material 06, with a counter-pressure cylinder 24, which is, for example, a steel cylinder 24, and can be placed against or removed from contact with the latter. In a first group of Preferred embodiments, the forme cylinder 01, together with the counter-pressure cylinder 24, constitutes a two-cylinder printing unit 33, which may be for example, a printing group for rotogravure or letterpress printing, in particular a flexographic printing group 33.

The forme cylinder 01 can be rotated independently of the counter-pressure cylinder 24. As a function of the operational state of the printing group, the forme cylinder 01 rotates, at times, at rotational speeds and/or in directions of rotation which are different from those of the counter-pressure cylinder 24. The counter-pressure cylinder 24 also rotates independently of the forme cylinder 01, at times.

In what follows, the operational states are defined in terms of rotational speed or of effective circumferential speed on the cylinder surfaces, which rotational or circumferential speeds are called "speeds" for short in what follows. The operational states referred to by the term "rotational speed" are to be applied in the same way as to the term "speed".

The forme cylinder 01 can be in one or another of several of the following operational states. It can be stopped, i.e. it will rotate at a rotational speed "zero" NFZ can also rotate at a production rotational speed PFZ or can rotate at a set-up rotational speed RFZ which set-up rotational speed is, as a rule, different from the stopped state speed NFZ and also from the production rotational speed PFZ.

The set-up rotational speed RFZ, in turn, can be a rotational speed DWFZ for a change of the printing forme, a rotational speed VEFZ for pre-inking, or a rotational speed WFZ for washing. A further set-up rotational speed, RFZ, can also be a rotational speed TFFZ for dry running, i.e. for the ink removal from the forme cylinder 01 on the web 06. The set-up rotational speed RFZ can also be a rotational speed EFZ for drawing in the web 06. In case of a direct image transfer to the surface of the forme cylinder 01 or onto the printing forme on the forme cylinder 01, the set-up rotational speed RFZ can also represent a rotational speed BBFZ for image transfer.

The production rotational speed PFZ for the forme cylinder for a double circumference lies, for example, between 20,000 and 50,000 revolutions per hour (r/h), and preferably between 35,000 to 45,000 r/h.

The rotational speed VEFZ characteristic for pre-inking the forme cylinder 01 lies, for example, in the range between 6,000 and 12,000 r/h.

For washing the forme cylinder 01, the rotational speed WFZ, for example, lies in the range between 200 to 1,000 r/h, and in particular between 300 and 800 r/h.

The rotational speed EFZ of the forme cylinder 01 turning along, for example, for drawing in the web 06 lies between 600 and 2,000 r/h, for example, in particular 300 to 800 r/h, which rotational speed EFZ approximately corresponds to a draw-in speed of the web 06 between 6 to 30 m/min, and in particular 6 to 12 m/min.

For the automatic change of the printing forme, the rotational speed DWFZ of the forme cylinder can lie between 300 r/h and 2,000 r/h, and in particular between 300 r/h and 1,000 r/h a rule, a reversal of the direction of rotation takes place during the plate or forme changing process. However, the rotational speed DWFZ can also lie between 120 and 300 r/h during a so-called tip operation. With a direct image transfer to the print forme or to the outer cylinder surface of the forme cylinder 01, for example by of laserdiodes, the rotational speed BBFZ of the forme cylinder 01, as a rule lies above the production rotational speed PFZ, for example above 50,000 r/h, and in particular lies above 70,000 r/h for web- fed printing presses, and above 5,000 r/h, and in particular between 5,000 and 30,000 r/h, for sheet printing presses.

The rotational speed TFFZ of the forme cylinder 01 for dry running, i.e. for ink removal from the forme cylinder 01, lies between 2,000 and 4,000 r/h.

The rotational speeds mentioned above preferably relate to forme cylinders 01 of a double circumference, i.e. to cylinders 01 on whose circumference two printing forms can be fastened, one after the other in the circumferential direction. The circumferences of the forme cylinder, to accomplish this, are a function of the printing format and lie, for example, between 900 mm and 1,300 mm. The rotational speeds of the forme cylinder 01 would have to be doubled in of the use of cylinders 01 of a single circumference. This correspondingly applies to printing groups, wherein a forme cylinder 01 of single circumference cooperates with a counter-pressure cylinder 24 of twice the circumference of the forme cylinder.

For one or for several of the rotational speed ranges of the forme cylinder 01 discussed above, either left or right directions of cylinder rotation are possible. These directions of rotation are defined in the subsequent drawing figures, which represent lateral or side elevation views of the cylinders 01.

The operational states, as well as the preferred rotational speeds, should also be applied to further forme cylinders added in the further course of the description of the preferred embodiments.

The inking roller 04, which is embodied as a screen or as an anilox roller 04, or as a rubber-coated ink application roller 04, can also either be stopped, go that it rotates at a rotational speed "zero" NW, or it can be operated at a production rotational speed PW, or at a set-up rotational speed RW. The setup rotational speed RW can be a rotational speed VEW for pre-inking, a rotational speed WW for washing, or a rotational speed WLW for the continued running of the inking roller 04.

The preferred rotational speed ranges of the inking roller 04 are a function of the printing process and/or the configuration of the printing unit, or of the inking system.

In the subsequent discussion, a differentiation is to be made between a simple rubber-coated ink application roller 04, an anilox or screen roller 04, as well as a screen roller 04 of twice the circumference. The inking roller, which is embodied as a simple rubber-coated ink application roller 04, preferably has approximately one-third the circumference of a forme cylinder 01 of double circumference. A screen roller 04 directly cooperating with the forme cylinder 01 can have the circumference of a forme cylinder 01 of single circumference or in case of letterpress or flexographic printing, of a forme cylinder 01 of circumference.

The production rotational speed PW, for example, of the inking roller 04 lies between 40,000 and 100,000 r/h for the anilox rollers 04 or screen rollers 04 of single circumference and directly cooperating with, the forme cylinder 01, and between 60,000 and 150,000 r/h in the case of the ink application roller 04. The production rotational speed PW of the screen roller 04 of twice the circumference lies between 20,000 and 50,000 r/h.

The rotational speed VEW for pre-inking of the inking roller 04 lies between 12,000 to 24,000 r/h, for example, in the case of the anilox roller 04 or the screen roller 04 of single circumference between 18,000 and 36,000 r/h in the case of an ink application roller 04.

For washing the inking roller 04, the rotational speed WW lies, for example, between 600 and 1,600 r/h in the case of the anilox roller 04 or the screen roller 04 of single circumference. This rotational speed lies between 900 and 2,400 r/h in the case of an ink application roller 04.

During continued running of the inking roller 04, in order to counter the drying of the ink, the rotational speed WLW preferably lies between 3,000 and 6,000 r/h for the screen roller 04 of twice the circumference, between 6,000 and 12,000 r/h for the screen roller 04 of single circumference, and between 9,000 and 18,000 r/h for the ink application roller 04.

As previously mentioned, the above-recited operational states are also defined by effective circumferential speeds, referred to simply as speeds for short, of the rotating bodies.

The production speed PFZ of the forme cylinder 01 lies between 6.4 and 16 m/s, for example, and in particular, between 11 and 15 m/s.

The speed, PWFZ of the forme cylinder 01 for the automated changing of the printing forme lies between 0.32 and 0.64 m/s, for example. For pre-inking the printing forme, the speed VEFZ of the forme cylinder 01 lies, for example, between 1.9 and 3.9 m/s, while for washing of the printing forme WFZ this speed lies between 0.06 and 0.32 m/s, for example, and in particular between, 0.10 and 0.26 m/s. For dry running TTFZ of the printing forme, the speed of the forme cylinder 01 lies, for example, between 0.64 and 1.3 m/s. As a rule, the speed of the forme cylinder 01 for image transfer BBFZ is greater than 16 m/s, and in particular is greater than 22 m/s for web-fed printing presses, and for sheet-fed printing presses this speed is greater than 1.6 m/s, and in-particular is between 1.6 and 9.6 m/s. For drawing in the web 06, the speed EFZ of the forme cylinder, 01 lies, for example, between 0.10 and 0.50 m/s, and in particular between 0.10 and 0.2 m/s.

The speeds of the inking roller 04 in the operational states where it is placed against the forme cylinder 01 are based on the speed of the latter, so that, for example, the production speed PW of the inking roller 04 also lies in the range between 6.4 and 16 m/s, and in particular between 11 and 15 m/s. If the inking roller 04 is embodied as a screen roller 04, its circumference can then approximately correspond, in size, to the circumference of a forme cylinder 01 of single circumference, for example. If the circumference of the screen roller 04 has been selected to be greater, for example to be between 1.0 and 1.2 m, the above mentioned rotational speeds PW of the screen roller 04 should be selected to be less. This correspondingly applies in case the inking roller 04 is embodied as an ink application roller 04, wherein the rotational speed to be selected is again a function of the circumference of the inking roller 04, which for example lies between 0.35 and 0.5 m.

For pre-inking, the speed of the inking roller 04 lies, for example, between 1.9 to 4.0 m/s, and for washing, this speed lies between 0.08 and 0.3 m/s. For continued running, the speed of the inking roller 04 lies, for example, between 0.95 and 1.95 m/s.

In where the circumference of the screen roller 04 lies in the lower circumferential range or below, such as is advantageous, for example, in the case of a double-sized forme cylinder 01 during direct printing operations, in an advantageous embodiment of the present invention the above mentioned ranges of the rotational speeds for the screen roller 04 should be increased by the appropriate rotational speed, for example by 0 to 30%, in particular by 10 to 20%, so that the advantageous range for the speed is approximately maintained.

Suitable, or desired rotational speeds for the rotating bodies 01, 04 previously mentioned, which are embodied as cylinders 01 and rollers 04, can be determined by use of the advantageous speeds, if the effective circumferences for the various diameters of the rotating bodies are known.

In the drawing figures, the rollers 04 are generalized and represented with a uniform diameter for the sake, of simplicity. The operational states are described in terms of rotational speeds in the preferred embodiments. However, the same preferred embodiments can also be read from the speeds characterizing the operational speeds.

The steel or counter-pressure cylinder 24 can either be stopped, so that it rotates at a rotational speed of "zero" NSZ, or can rotate at a production rotational speed PSZ or at a set-up rotational speed RSZ. The set-up rotational speed RSZ of, the steel cylinder 24 can be a rotational speed AWSZ for changing a cover or a dressing, a rotational speed ESZ for drawing in the web 06, a rotational speed WSZ for washing the steel cylinder 24,or a rotational speed TFSZ for dry running the ink removal from the forme cylinder 01 on the web 06.

The production rotational speed PSZ of the steel cylinder 24 lies, for example, between 20,000 and 50,000 r/h, and preferably at 35,000 to 45,000 r/h.

For changing a dressing, for example a foil, on the steel cylinder 24, the rotational speed AWSZ lies between 300 and 2,000 r/h, and in particular between 300 and 1,000 r/h.

The rotational speed ESZ of the steel cylinder 24 for drawing in the web 06, for example, lies between 300 and 2,000 r/h, and in particular 300 to 800 r/h.

For washing the steel cylinder 24, the rotational speed WSZ lies, for example, between 200 and 1,000 r/h, and in particular between 300 and 800 r/h.

The rotational speed TFSZ for dry running lies, for example, between 2,000 and 4,000 r/h, and in particular between 2,000 and 3,000 r/h, for the steel cylinder 24.

As already explained above in connection with the forme cylinder 01, the rotational speed ranges apply to cylinders 01, 24 of double circumference. When employing a steel cylinder 24 of single circumference, the rotational speeds will approximately double for the steel cylinder 24.

In case of a steel cylinder 24 of triple circumference which, for example, cooperates with one or two forme cylinders 01 of double circumference, in an advantageous manner, the above rotational speeds of the steel cylinder 24 should be multiplied by approximately ⅔.

In what has been discussed, the various operational states are also taking the place of operational states defined by the rotational speed or circumferential speeds, speeds for short.

The production speed PSZ of the steel cylinder 24, for example, lies between 6.4 and 16 m/s, and in particular between 11 and 15 m/s. The speed AWSZ of the steel cylinder 24 for changing the dressing, lies, for example, between 0.32 and 0.64 m/s, and in particular between 11 and 15 m/s. The speed SWSZ of the steel cylinder 24 for changing the dressing lies, for example, between 0.32 and 0.64 m/s, while for washing WSZ of the steel cylinder 24 it lies between 0.06 and 0.32 m/s, for example, and in particular between 0.10 and 0.26 m/s. For dry running TFFZ of the forme cylinder 01, the speed of the steel cylinder 24, for example, lies between 0.10 and 0.50 m/s. The speed ESZ for drawing lies, for example, between 0.10 and 0.50 m/s, and in particular between 0.10 and 0.2 m/s.

Suitable, or desired rotational speeds for the rotating body 24, which is embodied as a steel cylinder 24, can also be determined by use of the advantageous speeds, if the effective circumferences for various diameters are also known.

What has been said above also applies to directions of rotation, left and right rotation, as well as to the applicability of the rotational speed ranges, for further steel cylinders that are discussed in the subsequent description.

In a first, preferred embodiment of the present inventor, as seen in FIG. 1, the steel cylinder 24 rotates at the production rotational speed PSZ, for example clockwise or to the right, while the forme cylinder 01, which has been moved away from the steel cylinder 24, rotates at the set-up rotational speed DWFZ for changing the printing forme, or alternatively at the rotational speed BBFZ for image transfer. The forme cylinder 01 and the associated inking roller 04 are, for example, moved apart from each other, wherein the inking roller 04 also rotates at one of its set-up speeds RW. However, the inking roller 04 can also be in the stopped state NW, such as the case at the end of production, for example.

In a second preferred-embodiment, which is shown in FIG. 1, the inking roller 04 rotates at one of it's set-up rotational speeds RW, for example, at the rotational speed WLW for further running, for example turning clockwise or to the right, while the forme cylinder 01, which has been moved away from the steel cylinder 24, rotates at one of its set-up speeds RFZ, for example at its rotational speed DWFZ for changing the printing forme, or alternatively at the rotational speed BBFZ for image transfer. In another embodiment, the steel cylinder 24, and therefore the web 06, is in a stopped state NSZ. The steel cylinder 24 rotates, for example, at one of its set-up rotational speeds RSZ. If the web 06 is drawn in while the change of the printing forme occurs, the steel cylinder 24 can rotate at the rotational speed ESZ for drawing in the web 06.

Figure 3:
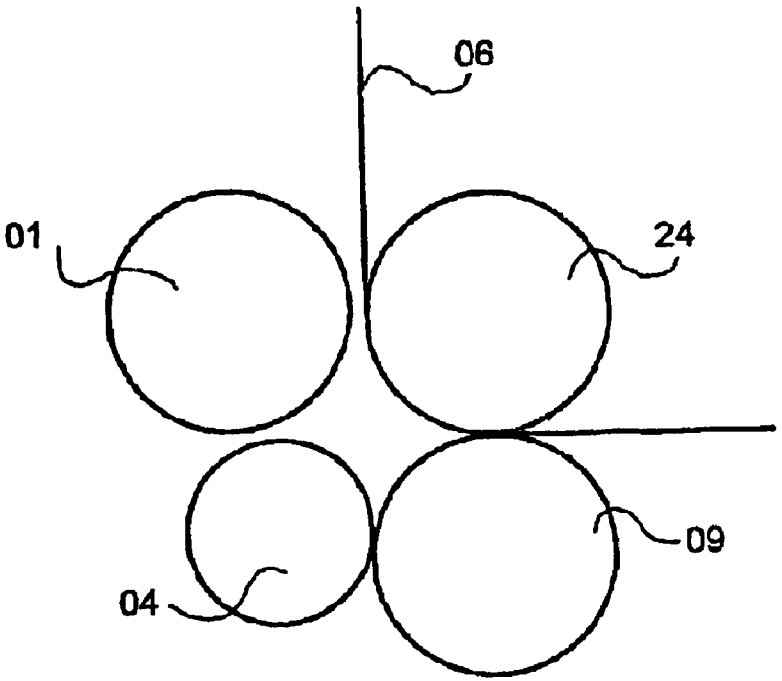

In a second group of preferred embodiments, depicted in FIG. 3, specifically third and fourth preferred embodiments, the steel cylinder 24 cooperates with the forme cylinder 01 and also with a second forme cylinder 09, wherein either both forme cylinders 01, 09 or selectively one of the forme cylinders 01, 09 or neither of the forme cylinders 01, 09, can be in contact. For the second forme cylinder 09, together with the steel cylinder 24, all operational states mentioned for the first forme cylinder 01 together with the steel cylinder 24 are possible, independently of and parallel with the operational states from the preferred embodiments one and two. The second forme cylinder can have its own inking roller 04, for whose operational states the same applies as has been said above. However, in the following examples, the first and second forme cylinders 01, 09 have the inking roller 04 in common.

Figure 4:
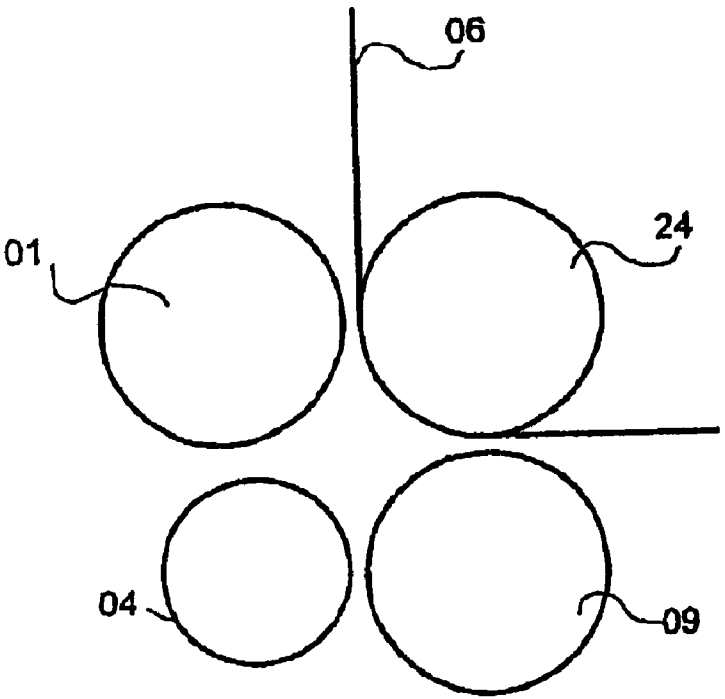

In a third preferred embodiment as depicted in FIG. 4, both forme cylinders 01, 09 are moved away from the steel cylinder 24. The steel cylinder 24 rotates at one of its set-up rotational speeds RST, for example at the rotational speed ESZ for the drawing in the web 06. At least one of the two forme cylinders 01, 02 rotates, for example, at one one of its set-up rotational speeds RFZ, and in particular at the rotational speed DWFZ for changing the printing forme, or alternatively at the rotational speed BBFZ for image transfer. However, in a variation, for guiding the web 06, one of the printing cylinders 01, 09 can rotate at the rotational speed EFZ for drawing in the web 06. The inking roller 04 can rotate at the rotational speed WLW for continued running, or it can be in the stopped state NW.

In a forth preferred embodiment, the steel cylinder 24 and at least one of the two forme cylinders 01, 09 rotate at one of their set-up rotating speeds RSZ, RFZ, for example at the rotational speed TFFZ, TFSZ for dry running, i.e. for removing ink from the forme cylinders 01, 09.

The embodiment of the inking roller 04 as a screen roller 04 is advantageous in the four preferred embodiments wherein it is, for example, 10 to 20% smaller than the cooperating cylinder 01, 09 of twice the circumference. The screen roller 04 has a circumference of approximately 0.96 m, and the forme cylinder 01, 09 has a circumference of approximately 1.2 m, for example.

It is advantageous for the four preferred embodiments, in particular for embodiments three and four, if the steel cylinder 24 and the inking roller 04 are stationarily arranged, while the forme cylinder or cylinders 01, 09 is or are embodied so it or they can be placed against the steel cylinder 24 and the inking roller 04, for example by pivoting.

It is of advantage of the above-described preferred embodiments if at least the cylinders 01, 09, which rotate differently in the preferred embodiments, and in particular if the cylinders that rotate at different rotational speeds, are each driven by their own drive motor. In a preferred embodiment, however, at least all of the forme cylinders 01, 09 of the described printing units can each be individually driven by their own drive motors, without a driven coupling to another cylinder 01, 09 or to an inking system. In that case, the drive motors en drive the respective cylinder 01, 09, or the inking system, during set-up operations, as well as during production.

The employment of position-regulated and/or rpm-regulated electric motors in the present invention is of particular advantage. This also applies to the drives for the rollers 04, which rollers 04 can either each have their own drive motor, or the inking system containing the roller 04 can have a drive motor, which inking system drive motor is independent of the cyclinders 01, 09.

While preferred embodiments of a printing unit in accordance with the present invention have been set forth fully and completely herein above, it will be apparent to one of skill in the at that various changes in, for example the type of web being printed, the specific type of printing press and the like could be made without departing from the true spirit and scope of the present invention which is accordingly to be limited only by the following claims.

What is claimed is:

1. A printing unit comprising:

at least three rotating bodies which cooperate in pairs in a print-on position of the printing unit, said at least three rotating bodies including a counter-pressure cylinder, at least one forme cylinder which cooperates with said counter-pressure cylinder in the print-on position, and at least one inking roller which cooperates with said forme cylinder in the print-on position;

a drive motor for said at least one forme cylinder; and a drive motor for said counter-pressure cylinder, said at least one forme cylinder drive motor and said counter-pressure cylinder drive motor being out of drive connection with any other of said at least three rotating bodies, each said at least one forme cylinder and said counter-pressure cylinder being selectively rotatable by each said associated drive motor at a set-up rotational speed, and at a production rotational speed, each said set-up rotational speed and said production rotational speed for each said at least one forme cylinder and said counter-pressure cylinder being different from a zero rotational speed.

2. The printing unit of claim 1 further including a second forme cylinder engageable with said counter-pressure cylinder.

3. The printing unit of claim 2 wherein said at least one inking roller is a common inking roller that selectively contacts one of said first and second forme cylinders.

4. The printing unit of claim 3 wherein at least one of said first and second forme cylinders is at zero rotational speed while said counter-pressure cylinder is at said set-up speed.

5. The printing unit of claim 1 wherein said inking roller is at a set-up rotational speed.

6. The printing unit of claim 1 wherein said inking roller is at a zero rotational speed.

7. The printing unit of claim 1 wherein said forme cylinder set-up rotational speed is a speed required for a change of a printing forme on said at least one forme cylinder.

8. The printing unit of claim 1 wherein said forme cylinder set-up rotational speed is a speed required for an image transfer to said at least one forme cylinder.

9. The printing unit of claim 1 wherein said forme cylinder set-up rotational speed is a speed required for a pre-inking of said at least one forme cylinder.

10. The printing unit of claim 1 wherein said forme cylinder set-up rotational speed is a speed required for a drawing in of a web.

11. The printing unit of claim 1 wherein said forme cylinder set-up rotational speed is a speed required for a dry running of said at least one forme cylinder.

12. The printing unit of claim 1 wherein said counter-pressure cylinder set-up rotational speed is a speed required for changing a dressing on said counter-pressure cylinder.

13. The printing unit of claim 1 wherein said counter-pressure cylinder set-up rotational speed is a speed required for drawing in a web.

14. The printing unit of claim 5 wherein said inking roller set-up rotational speed is a speed required for inking said inking roller.

15. The printing unit of claim 5 wherein said inking roller set-up rotational is equal to a rotational speed for a continued running of said inking roller.

16. The printing unit of claim 1 wherein each of said at least three rotating bodies has its own drive motor.

17. The printing unit of claim 1 wherein said at least one inking roller is driven by a drive motor independent of said at least one forme cylinder and said counter-pressure cylinder.

18. The printing unit of claim 16 wherein each said drive motor is a position-regulated electric motor.

19. The printing unit of claim 17 wherein said at least one inking roller drive motor is a position-regulated electric motor.

20. The printing unit of claim 16 wherein each said drive motor is an rpm-regulated electric motor.

21. The printing unit of claim 17 wherein said at least one inking roller drive motor is an rpm-regulated electric motor.

22. The printing unit of claim 1 wherein said production rotational speed is a function of a desired circumferential speed of a least one of said three rotating bodies.

23. The printing unit of claim 1 wherein said set-up rotational speed is a function of a desired rotational speed of at least one of said three rotating bodies.

* * * * *